US010486431B2

(12) United States Patent
Sugitani

(10) Patent No.: US 10,486,431 B2
(45) Date of Patent: Nov. 26, 2019

(54) INKJET PRINTER

(71) Applicant: RISO KAGAKU CORPORATION, Tokyo (JP)

(72) Inventor: Hiroshi Sugitani, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/762,248

(22) PCT Filed: Sep. 6, 2016

(86) PCT No.: PCT/JP2016/076171
§ 371 (c)(1),
(2) Date: Mar. 22, 2018

(87) PCT Pub. No.: WO2017/051701
PCT Pub. Date: Mar. 30, 2017

(65) Prior Publication Data

US 2018/0272738 A1 Sep. 27, 2018

(30) Foreign Application Priority Data

Sep. 24, 2015 (JP) ..... 2015-186724

(51) Int. Cl.
*B41J 2/18* (2006.01)
*B41J 2/175* (2006.01)
*B41J 2/14* (2006.01)

(52) U.S. Cl.
CPC ..... *B41J 2/18* (2013.01); *B41J 2/175* (2013.01); *B41J 2/14201* (2013.01); *B41J 2202/02* (2013.01)

(58) Field of Classification Search
CPC ..... B41J 2/175; B41J 2/17556; B41J 29/377; B41J 2/18; B41J 2/01
(Continued)

(56) References Cited

U.S. PATENT DOCUMENTS 7,850,290 B2 12/2010 Nitta et al.
9,272,524 B1 * 3/2016 Sugitani ..... B41J 2/17596
(Continued)

FOREIGN PATENT DOCUMENTS

CN 101209624 A 7/2008
CN 203697710 U 7/2014
(Continued)

OTHER PUBLICATIONS

Official Communication issued in Japan Patent Application No. PCT/JP2016/076171, dated Oct. 18, 2016, along with English-translation thereof.
(Continued)

*Primary Examiner* — An H Do
(74) *Attorney, Agent, or Firm* — Greenblum & Bernstein, P.L.C.

(57) ABSTRACT

An inkjet printer includes: a pressurized space and a depressurized space for circulation of ink along a circulation path; a main connection path and an adjustment path connecting the pressurized space and the depressurized space to each other; an air pump configured to send air from the depressurized space to the pressurized space though the main connection path or the adjustment path; a changeover device configured to change over between the main connection path and the adjustment path; and a controller. The controller drives the air pump with the main connection path being set to generate preset pressures respectively in the pressurized space and the depressurized space and then controls the air pump with the adjustment path being changed over to maintain pressures in the pressurized space and the depressurized space respectively at the preset pressures.

20 Claims, 3 Drawing Sheets

(58) Field of Classification Search
USPC ..... 347/6, 84, 85, 89
See application file for complete search history.

(56) References Cited

U.S. PATENT DOCUMENTS

| | | | |
|---|---|---|---|
| 9,296,217 | B2 | 3/2016 | Obata |
| 2009/0009544 | A1 | 1/2009 | Kumagai et al. |
| 2012/0188314 | A1 | 7/2012 | Akiyama et al. |

FOREIGN PATENT DOCUMENTS

| | | | |
|---|---|---|---|
| CN | 104220263 | A | 12/2014 |
| CN | 204547353 | U | 8/2015 |
| EP | 3095606 | A1 | 11/2016 |
| EP | 3354464 | A1 | 8/2018 |
| JP | 63-116373 | | 5/1988 |
| JP | 07-145872 | | 6/1995 |
| JP | 08-138603 | | 5/1996 |
| JP | 2005-125669 | | 5/2005 |
| JP | 2009-29109 | | 2/2009 |
| JP | 2010-228350 | | 10/2010 |
| JP | 2012-153004 | | 8/2012 |
| WO | 2014/009232 | A1 | 1/2014 |

OTHER PUBLICATIONS

Apr. 10, 2019 extended European Search Report in corresponding European Application No. 16848489.7.
Official Action dated Dec. 3, 2018 in the counterpart Chinese application No. 201680055843.9.

* cited by examiner

INKJET PRINTER

TECHNICAL FIELD

The present invention relates to an inkjet printer of an ink circulation type.

BACKGROUND ART

An inkjet printer of an ink circulation type is known. The inkjet printer of the ink circulation type performs printing by ejecting an ink from an inkjet head while circulating the ink.

Patent Literature 1 listed below discloses an inkjet printer which circulates an ink by using a pressure difference obtained by causing an air pump to increase a pressure in a positive pressurization tank provided upstream of an inkjet head in an ink circulation path and decrease a pressure in a negative pressurization tank provided downstream of the inkjet head in the ink circulation path.

The inkjet printer of this type sends air from the negative pressurization tank to the positive pressurization tank at the start of ink circulation by driving the air pump to generate preset pressures respectively in the positive pressurization tank and the negative pressurization tank for the ink circulation. Thereafter, the air pump is driven depending on pressure fluctuation in the positive pressurization tank and the negative pressurization tank to maintain the pressures in the positive pressurization tank and the negative pressurization tank.

In the maintaining of the pressures after the generation of the preset pressures, the drive rate (drive duty ratio) of the air pump is set lower than that in the generation of the preset pressures. Performing such control achieves fine pressure adjustment with the pressure fluctuation being suppressed.

CITATION LIST

Patent Literature

Patent Literature 1: Japanese Patent Application Publication No. 2012-153004

SUMMARY OF INVENTION

However, when the air pump is driven at a low drive rate, the air flow volume sometimes becomes unstable. This increases the pressure fluctuation in the positive pressurization tank and the negative pressurization tank and the nozzle pressure in the inkjet head sometimes greatly fluctuates. As a result, ejection of the ink from the inkjet head becomes unstable and print quality decreases.

An object of the present invention is to provide an inkjet printer which can suppress a decrease in print quality.

The feature of the present invention is to provide an inkjet printer including: a print unit configured to eject ink from a nozzle of an inkjet head while circulating the ink along a circulation path; a pressurized space configured to be pressurized for circulation of the ink along the circulation path; a depressurized space configured to be depressurized for the circulation of the ink along the circulation path; a main connection path connecting the pressurized space and the depressurized space to each other; an adjustment path connecting the pressurized space and the depressurized space to each other, the adjustment path formed by a portion of the main connection path and a path having an air passage narrower than an air passage of the main connection path; an air pump arranged in the portion of the main connection path and configured to send air from the depressurized space to the pressurized space; a changeover device configured to change over a usage path from the main connection path to the adjustment path and vice versa, the usage path being a path used as an air passage between the pressurized space and the depressurized space in drive of the air pump; and a controller configured to drive the air pump with the main connection path set as the usage path by the changeover device to generate preset pressures respectively in the pressurized space and the depressurized space and then control the drive of the air pump with the usage path changed over to the adjustment path by the changeover device to maintain pressures in the pressurized space and the depressurized space respectively at the preset pressures.

In the characteristics described above, in the maintaining of the pressures in the pressurized space and the depressurized space, the air flow volume from the depressurized space to the pressurized space can be adjusted by using the adjustment path having the air passage narrower than the air passage of the main connection path. Specifically, the air flow volume from the depressurized space to the pressurized space can be adjusted without controlling the drive rate of the air pump. Accordingly, it is possible to avoid pressure fluctuation in the pressurized space and the depressurized space which is caused by unstable air flow volume in the case where the air pump is driven at a low drive rate. As a result, it is possible to reduce fluctuation of a nozzle pressure of the inkjet head and suppress a decrease in print quality.

DESCRIPTION OF EMBODIMENTS

Figure 1:
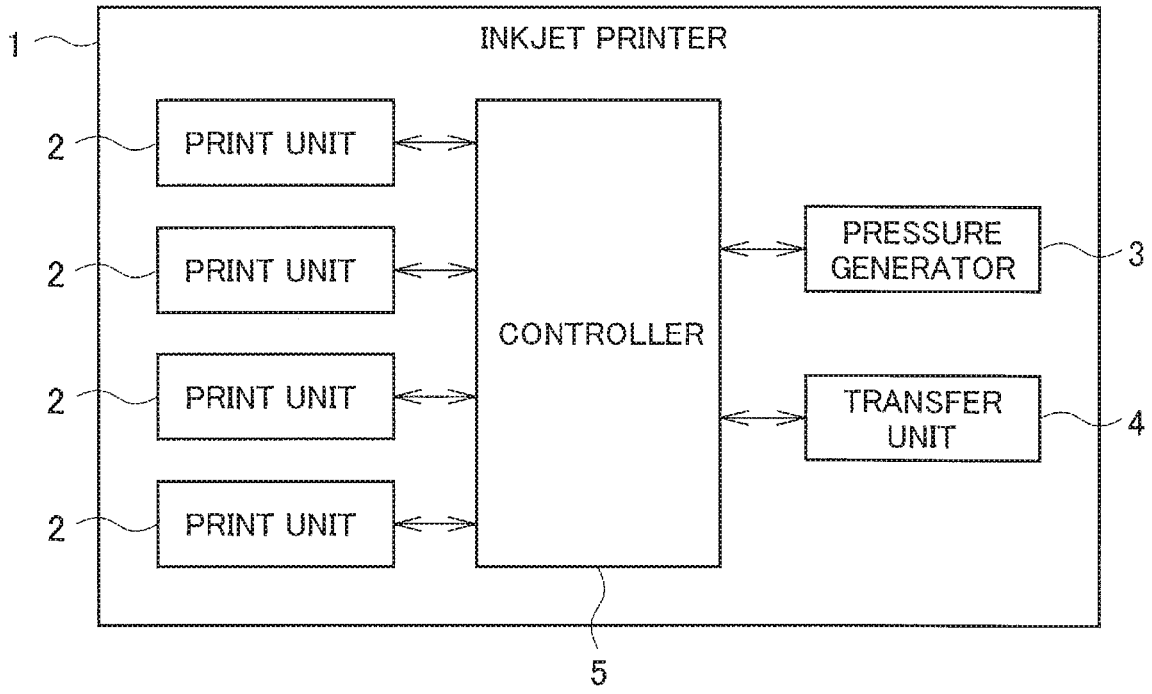
FIG. 1 is a block diagram illustrating an inkjet printer according to an embodiment.

An embodiment is described below with reference to the drawings. In the drawings, the same or similar constitutional elements are denoted by the same reference numerals.

The embodiment described below shows an example of an apparatus and the like which embody the technical spirit of the present invention. The technical spirt of the present invention is not limited to materials, shapes, structures, arrangements, and the like of constitutional elements described in the following embodiment and various changes may be made in the scope of claim.

As illustrated in FIG. 1, an inkjet printer 1 according to the embodiment includes four print units 2, a pressure generator 3, a transfer unit 4, and a controller 5.

Each of the print units 2 prints an image by ejecting an ink to a sheet transferred by the transfer unit 4 while circulating the ink. The four print units 2 eject inks of different colors (for example, black, cyan, magenta, and yellow), respectively. The four print units 2 have the same configuration except for the point that the colors of inks ejected therefrom are different.

Figure 2:
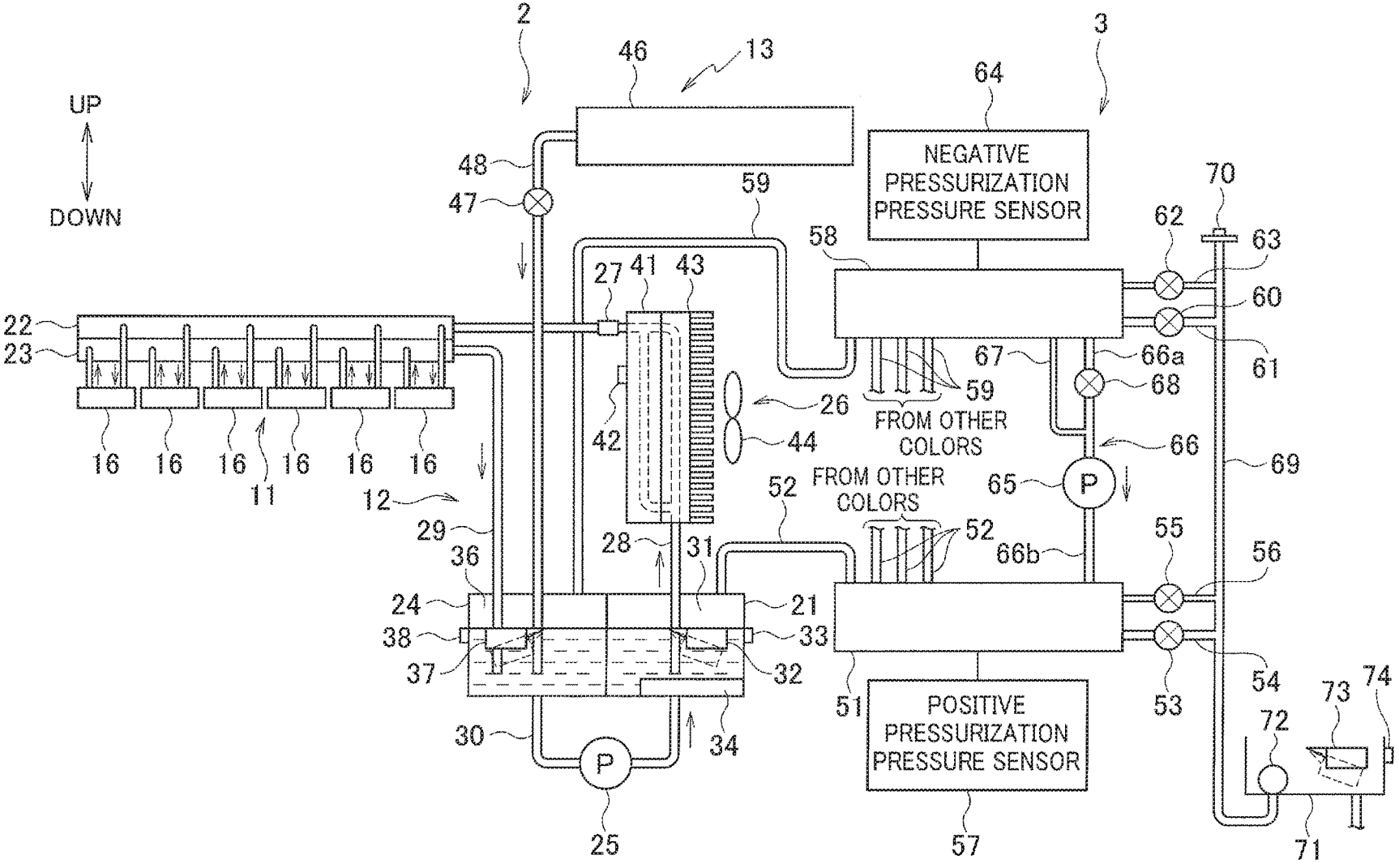
FIG. 2 is a schematic configuration diagram of a print unit and a pressure generator in the inkjet printer.

As illustrated in FIG. 2, each of the print units 2 includes an inkjet head 11, an ink circulator 12, and an ink reservoir 13.

The inkjet head 11 ejects the ink supplied by the ink circulator 12. The inkjet head 11 includes multiple head modules 16.

Each of the head modules 16 has ink chambers (not illustrated) for storing the ink and multiple nozzles (not illustrated) for ejecting the ink. Piezoelectric elements (not illustrated) are arranged in the ink chambers. The ink is ejected from the nozzles by drive of the piezoelectric elements.

The ink circulator 12 supplies the ink to the inkjet head 11 while circulating the ink. The ink circulator 12 includes a positive pressurization tank 21, a distributor 22, a collector 23, a negative pressurization tank 24, an ink pump 25, an ink temperature adjuster 26, an ink temperature sensor 27, and ink circulation pipes 28 to 30.

The positive pressurization tank 21 stores the ink to be supplied to the inkjet head 11. The ink in the positive pressurization tank 21 is supplied to the inkjet head 11 through the ink circulation pipe 28 and the distributor 22. An air space 31 is formed on a liquid surface of the ink in the positive pressurization tank 21. The positive pressurization tank 21 communicates with a positive pressurization communal air chamber 51 to be described later through a positive pressurization communicating pipe 52 to be described later. The positive pressurization tank 21 is arranged below (under) the inkjet head 11.

The positive pressurization tank 21 is provided with a float member 32, a positive pressurization tank liquid level sensor 33, and an ink filter 34.

The float member 32 is pivotally supported at one end by a supporting shaft (not illustrated) in the positive pressurization tank 21 to swing depending on the liquid level height of the ink in the positive pressurization tank 21 when the liquid level height is a reference height or less. The float member 32 does not swing above the liquid level height even when the liquid level height of the ink in the positive pressurization tank 21 exceeds the reference height. A magnet (not illustrated) is provided at the other end of the float member 32.

The positive pressurization tank liquid level sensor 33 detects whether the liquid level height of the ink in the positive pressurization tank 21 has reached the reference height. The reference height is below the upper end of the positive pressurization tank 21. The positive pressurization tank liquid level sensor 33 is a magnetic sensor which detects the magnet of the float member 32 when the liquid level height has reached the reference height. When the positive pressurization tank liquid level sensor 33 detects the magnet of the float member 32, that is when the liquid level height in the positive pressurization tank 21 is the reference height or more, the positive pressurization tank liquid level sensor 33 outputs a signal indicating "on." When the positive pressurization tank liquid level sensor 33 does not detect the magnet of the float member 32, that is when the liquid level height in the positive pressurization tank 21 is less than the reference height, the positive pressurization tank liquid level sensor 33 outputs a signal indicating "off."

The ink filter 34 removes dusts and the like in the ink.

The distributor 22 distributes the ink supplied from the positive pressurization tank 21 through the ink circulation pipe 28 to the head modules 16 in the inkjet head 11.

The collector 23 collects the ink not consumed in the inkjet head 11 from the head modules 16. The ink collected by the collector 23 flows to the negative pressurization tank 24 through the ink circulation pipe 29.

The negative pressurization tank 24 receives the ink not consumed in the inkjet head 11 from the collector 23 and stores the ink. Moreover, the negative pressurization tank 24 stores the ink fed from an ink cartridge 46 in the ink reservoir 13 to be described later. An air space 36 is formed on the liquid surface of the ink in the negative pressurization tank 24. The negative pressurization tank 24 communicates with a negative pressurization communal air chamber 58 to be described later through a negative pressurization communicating pipe 59 to be described later. The negative pressurization tank 24 is arranged at the same height as the positive pressurization tank 21.

The negative pressurization tank 24 is provided with a float member 37 and a negative pressurization tank liquid level sensor 38.

The float member 37 is similar to the float member 32 of the positive pressurization tank 21. The negative pressurization tank liquid level sensor 38 is also similar to the positive pressurization tank liquid level sensor 33 of the positive pressurization tank 21. When the negative pressurization tank liquid level sensor 38 detects the magnet of the float member 37, that is when the liquid level height in the negative pressurization tank 24 is the reference height or more, the negative pressurization tank liquid level sensor outputs a signal indicating "on." When the negative pressurization tank liquid level sensor 38 does not detect the magnet of the float member 37, that is when the liquid level height in the negative pressurization tank 24 is less than the reference height, the negative pressurization tank liquid level sensor 38 outputs a signal indicating "off." The reference height is below the upper end of the negative pressurization tank 24.

The ink pump 25 sends the ink from the negative pressurization tank 24 to the positive pressurization tank 21. The ink pump 25 is provided in the middle of the ink circulation pipe 30.

The ink temperature adjuster 26 adjusts the temperature of the ink in the ink circulator 12. The ink temperature adjuster 26 is provided in the middle of the ink circulation pipe 28. The ink temperature adjuster 26 includes a heater 41, a heater temperature sensor 42, a heat sink 43, and a cooling fan 44. The heat sink 43 and the cooling fan 44 form a heat radiator.

The heater 41 heats the ink in the ink circulation pipe 28. The heater temperature sensor 42 detects the temperature of the heater 41. The heat sink 43 releases heat of the ink in the ink circulation pipe 28. The cooling fan 44 sends cooling wind to the heat sink 43 to promote the release of heat.

In the embodiment, the heater 41 and the heat sink 43 are integrated. Accordingly, when the heater 41 is generating heat, the heat of the heater 41 is transmitted to the heat sink 43 and the heat sink 43 also functions as a heater. Meanwhile, when the heat is released from the heat sink 43 by using the cooling fan 44, the heat of the heater 41 is transmitted to the heat sink 43 and is released from the heat sink 43. In other words, the heater 41 also functions as a heat sink in this case.

The ink temperature sensor 27 detects the temperature of the ink in the ink circulator 12. The ink temperature sensor 27 is provided in the middle of the ink circulation pipe 28. More specifically, the ink temperature sensor 27 is arranged to detect the temperature of the ink just sent out from the ink temperature adjuster 26.

The ink circulation pipe 28 connects the positive pressurization tank 21 to the distributor 22. The ink circulation pipe 28 is partially divided into a portion passing through the heater 41 and a portion passing through the heat sink 43. In the ink circulation pipe 28, the ink flows from the positive pressurization tank 21 to the distributor 22. The ink circulation pipe 29 connects the collector 23 to the negative pressurization tank 24. In the ink circulation pipe 29, the ink flows from the collector 23 to the negative pressurization tank 24. The ink circulation pipe 30 connects the negative pressurization tank 24 to the positive pressurization tank 21. In the ink circulation pipe 30, the ink flows from the negative pressurization tank 24 to the positive pressurization tank 21. The ink circulation pipes 28 to 30, the distributor 22, and the collector 23 form a circulation path for circulating the ink in the positive pressurization tank 21, the inkjet head 11, and the negative pressurization tank 24.

The ink reservoir 13 feeds the ink to the ink circulator 12. The ink reservoir 13 includes the ink cartridge 46, an ink reservoir valve 47, and an ink reservoir pipe 48.

The ink cartridge 46 contains the ink used for printing by the inkjet head 11. The ink in the ink cartridge 46 is supplied to the negative pressurization tank 24 of the ink circulator 12 through the ink reservoir pipe 48.

The ink reservoir valve 47 opens and closes a flow path of the ink in the ink reservoir pipe 48. The ink reservoir valve 47 is opened when the ink is to be fed to the negative pressurization tank 24.

The ink reservoir pipe 48 connects the ink cartridge 46 to the negative pressurization tank 24. In the ink reservoir pipe 48, the ink flows from the ink cartridge 46 to the negative pressurization tank 24.

The pressure generator 3 generates pressure for circulating the ink in the positive pressurization tank 21 and the negative pressurization tank 24 in each print unit 2. The pressure generator 3 includes the positive pressurization communal air chamber 51, four positive pressurization communicating pipes 52, a positive pressurization atmospheric release valve 53, a positive pressurization atmospheric release pipe 54, a positive pressurization pressure regulation valve 55, a positive pressurization pressure regulation pipe 56, a positive pressurization pressure sensor 57, the negative pressurization communal air chamber 58, four negative pressurization communicating pipes 59, a negative pressurization atmospheric release valve 60, a negative pressurization atmospheric release pipe 61, a negative pressurization pressure regulation valve 62, a negative pressurization pressure regulation pipe 63, a negative pressurization pressure sensor 64, an air pump 65, an air pump pipe 66, a flow volume regulation pipe 67, an air flow path changeover valve 68, a combined pipe 69, an air filter 70, and an overflow pan 71.

The positive pressurization communal air chamber 51 is an air chamber for equalizing the pressures in the positive pressurization tanks 21 of all print units 2. The positive pressurization communal air chamber 51 communicates with the air spaces 31 in the positive pressurization tanks 21 of the four print units 2, through the four positive pressurization communicating pipes 52. The positive pressurization tanks 21 of all print units 2 thereby communicate with one another through the positive pressurization communal air chamber 51 and the positive pressurization communicating pipes 52.

The positive pressurization communicating pipes 52 causes the positive pressurization communal air chamber 51 to communicate with the air spaces 31 in the positive pressurization tanks 21. The four positive pressurization communicating pipes 52 are provided to correspond respectively to the four print units 2. One ends of the positive pressurization communicating pipes 52 are connected to the positive pressurization communal air chamber 51 and other ends of the positive pressurization communicating pipes 52 are connected to the air spaces 31 in the positive pressurization tanks 21.

The positive pressurization atmospheric release valve 53 opens and closes an air passage in the positive pressurization atmospheric release pipe 54 to switch the positive pressurization tanks 21 from a closed state (hermetically-sealed state) to an atmospheric release state (state communicating with the atmosphere) and vice versa through the positive pressurization communal air chamber 51. Note that the hermetically-sealed state is also referred to as air-tight state. The positive pressurization atmospheric release valve 53 is provided in the middle of the positive pressurization atmospheric release pipe 54.

The positive pressurization atmospheric release pipe 54 forms the air passage for releasing air in the positive pressurization tanks 21 to the atmosphere through the positive pressurization communal air chamber 51. One end of the positive pressurization atmospheric release pipe 54 is connected to the positive pressurization communal air chamber 51 and the other end of the positive pressurization atmospheric release pipe 54 is connected to the combined pipe 69.

The positive pressurization pressure regulation valve 55 opens and closes an air passage in the positive pressurization pressure regulation pipe 56 to adjust the pressure in the positive pressurization communal air chamber 51 and the positive pressurization tanks 21. The positive pressurization pressure regulation valve 55 is provided in the middle of the positive pressurization pressure regulation pipe 56.

The positive pressurization pressure regulation pipe 56 forms the air passage for adjusting the pressure in the positive pressurization communal air chamber 51 and the positive pressurization tanks 21. The positive pressurization pressure regulation pipe 56 is narrower than the positive pressurization atmospheric release pipe 54, the negative pressurization atmospheric release pipe 61, and the combined pipe 69. One end of the positive pressurization pressure regulation pipe 56 is connected to the positive pressurization communal air chamber 51 and the other end of the positive pressurization pressure regulation pipe 56 is connected to the combined pipe 69.

The positive pressurization pressure sensor 57 detects the pressure in the positive pressurization communal air chamber 51. Since the positive pressurization communal air chamber 51 and the air spaces 31 in the positive pressurization tanks 21 communicate with one another, the pressure in the positive pressurization communal air chamber 51 is equal to the pressures in the positive pressurization tanks 21 of the respective print units 2.

The negative pressurization communal air chamber 58 is an air chamber for equalizing the pressures in the negative pressurization tanks 24 of all print units 2. The negative pressurization communal air chamber 58 communicates with the air spaces 36 in the negative pressurization tanks 24 of the four print units 2, through the four negative pressurization communicating pipes 59. The negative pressurization tanks 24 of all print units 2 thereby communicate with one another through the negative pressurization communal air chamber 58 and the negative pressurization communicating pipes 59.

The negative pressurization communicating pipes 59 causes the negative pressurization communal air chamber 58 to communicate with the air spaces 36 in the negative pressurization tanks 24. The four negative pressurization communicating pipes 59 are provided to correspond respectively to the four print units 2. One ends of the negative pressurization communicating pipes 59 are connected to the negative pressurization communal air chamber 58 and other ends of the negative pressurization communicating pipes 59 are connected to the air spaces 36 in the negative pressurization tanks 24.

The negative pressurization atmospheric release valve 60 opens and closes an air passage in the negative pressurization atmospheric release pipe 61 to switch the negative pressurization tanks 24 from the closed state to the atmospheric release state and vice versa through the negative pressurization communal air chamber 58. The negative pressurization atmospheric release valve 60 is provided in the middle of the negative pressurization atmospheric release pipe 61.

The negative pressurization atmospheric release pipe 61 forms the air passage for releasing the air in the negative pressurization tanks 24 to the atmosphere through the negative pressurization communal air chamber 58. One end of the negative pressurization atmospheric release pipe 61 is connected to the negative pressurization communal air chamber 58 and the other end of the negative pressurization atmospheric release pipe 61 is connected to the combined pipe 69.

The negative pressurization pressure regulation valve 62 opens and closes an air passage in the negative pressurization pressure regulation pipe 63 to adjust the pressure in the negative pressurization communal air chamber 58 and the negative pressurization tanks 24. The negative pressurization pressure regulation valve 62 is provided in the middle of the negative pressurization pressure regulation pipe 63.

The negative pressurization pressure regulation pipe 63 forms the air passage for adjusting the pressure in the negative pressurization communal air chamber 58 and the negative pressurization tanks 24. The negative pressurization pressure regulation pipe 63 is narrower than the positive pressurization atmospheric release pipe 54, the negative pressurization atmospheric release pipe 61, and the combined pipe 69. One end of the negative pressurization pressure regulation pipe 63 is connected to the negative pressurization communal air chamber 58 and the other end of the negative pressurization pressure regulation pipe 63 is connected to the combined pipe 69.

The negative pressurization pressure sensor 64 detects the pressure in the negative pressurization communal air chamber 58. Since the negative pressurization communal air chamber 58 and the air spaces 36 in the negative pressurization tanks 24 communicate with one another, the pressure in the negative pressurization communal air chamber 58 is equal to the pressures in the negative pressurization tanks 24 of the respective print units 2.

The air pump 65 sucks air from the negative pressurization communal air chamber 58 and sends the sucked air to the positive pressurization communal air chamber 51 to generate a pressure difference between insides of the positive pressurization tanks 21 and insides of the negative pressurization tanks 24. The air pump 65 is arranged in the middle of the air pump pipe 66.

The air pump pipe 66 connects the negative pressurization communal air chamber 58 to the positive pressurization communal air chamber 51. Specifically, the air pump pipe 66 connects a pressurized air space and a depressurized air space for circulating the inks along the circulation paths of the ink circulators 12 to each other. The pressurized air space for the ink circulation includes the air spaces 31 in the positive pressurization tanks 21, the positive pressurization communal air chamber 51, and the positive pressurization communicating pipes 52. The depressurized air space for the ink circulation includes the airspaces 36 in the negative pressurization tanks 24, the negative pressurization communal air chamber 58, and the negative pressurization communicating pipes 59.

The flow volume regulation pipe 67 is a pipe for suppressing the volume of air flowing from the negative pressurization communal air chamber 58 to the positive pressurization communal air chamber 51. One end of the flow volume regulation pipe 67 is connected to the negative pressurization communal air chamber 58 and the other end of the flow volume regulation pipe 67 is connected to the air pump pipe 66 on the negative pressurization communal air chamber 58 side of the air pump 65. An air passage in the flow volume regulation pipe 67 is narrower than an air passage in the air pump pipe 66. Specifically, the flow volume regulation pipe 67 is thinner than the air pump pipe 66.

Here, a section of the air pump pipe 66 upstream (on the negative pressurization communal air chamber 58 side) of the position of a connection portion with the flow volume regulation pipe 67 is referred to as upstream portion 66*a* and a section of the air pump pipe 66 downstream (on the positive pressurization communal air chamber 51 side) of the position of the connection portion is referred to as downstream portion 66*b*. The flow volume regulation pipe 67 and the downstream portion 66*b* of the air pump pipe 66 form an adjustment path. Moreover, the upstream portion 66*a* and the downstream portion 66*b* of the air pump pipe 66 form a main connection path. In other words, the downstream portion 66*b* is part of the main connection path and is also part of the adjustment path.

Note that the entire flow volume regulation pipe 67 does not have to be narrower than the air pump pipe 66. It is only necessary that at least part of the flow path of the flow volume regulation pipe 67 has a smaller cross-sectional area than the cross-sectional area of the flow path of the air pump pipe 66.

The air flow path changeover valve 68 opens and closes the air passage in the air pump pipe 66 (upstream portion 66*a*) to change over a usage path used during the drive of the air pump 65. The air flow path changeover valve 68 is provided in the upstream portion 66 a of the air pump pipe 66. The air flow path changeover valve 68 is a changeover device configured to change over the air passage from the pressurized air space to the depressurized air space and vice versa.

When the air flow path changeover valve 68 is open, the main connection path formed of the upstream portion 66*a* and the downstream portion 66*b* of the air pump pipe 66 is selected as the usage path. When the air flow path changeover valve 68 is closed, the adjustment path formed of the flow volume regulation pipe 67 and the downstream portion 66*b* of the air pump pipe 66 is selected as the usage path. The downstream portion 66*b* of the air pump pipe 66 is a path common to the main connection path and the adjustment path.

One end of the combined pipe 69 is connected to the overflow pan 71 and the other end (upper end) of the combined pipe 69 communicates with the atmosphere through the air filter 70. The one end of the combined pipe 69 is normally closed by an overflow ball 72 to be described later. The positive pressurization atmospheric release pipe 54, the positive pressurization pressure regulation pipe 56, the negative pressurization atmospheric release pipe 61, and the negative pressurization pressure regulation pipe 63 are connected to the combined pipe 69. The positive pressurization atmospheric release pipe 54, the positive pressurization pressure regulation pipe 56, the negative pressurization atmospheric release pipe 61, and the negative pressurization pressure regulation pipe 63 can communicate with the atmosphere through the combined pipe 69.

The air filter 70 prevents dust and the like in air from entering the combined pipe 69. The air filter 70 is installed at the upper end of the combined pipe 69.

The overflow pan 71 receives the ink flowing out from the combined pipe 69, for example, when the ink overflows from the positive pressurization tank 21 and/or the negative pressurization tank 24 and further overflows from the positive pressurization communal air chamber 51 and/or the negative pressurization communal air chamber 58 due to failure of the ink reservoir valve 47.

The overflow ball 72 is provided in the overflow pan 71. The overflow ball 72 closes the one end of the combined pipe 69 open on a bottom surface of the overflow pan 71 when there is no ink in the overflow pan 71, and prevents external air from flowing into the combined pipe 69. The ink flowing into the overflow pan 71 from the combined pipe 69 causes the overflow ball 72 to float and accumulates in the overflow pan 71.

Moreover, the overflow pan 71 is provided with a float member 73 and an overflow liquid level sensor 74. The float member 73 and the overflow liquid level sensor 74 are similar to the float member 32 and the positive pressurization tank liquid level sensor 33 in each positive pressurization tank 21.

The overflow pan 71 is connected to a waste liquid tank (not illustrated). When the overflow liquid level sensor 74 is turned on, the ink in the overflow pan 71 is discharged to the waste liquid tank.

The transfer unit 4 picks up a sheet from a sheet feeding tray (not illustrated) and transfers the sheet along a transfer route. The transfer unit 4 includes rollers (not illustrated) for transferring the sheet, a motor (not illustrated) for driving the rollers, and the like.

The controller 5 controls operations of units in the inkjet printer 1. The controller 5 includes a CPU, a RAM, a ROM, a hard disk drive, and the like.

The controller 5 controls the print units 2 and the pressure generator 3 such that the print units 2 and the pressure generator 3 perform printing by ejecting the inks from the inkjet heads 11 while circulating the inks in the ink circulators 12.

The controller 5 opens the air flow path changeover valve 68 at the start of the ink circulation and sets the main connection path (path formed of the upstream portion 66*a* and the downstream portion 66 b of the air pump pipe 66) as the usage path used during the drive of the air pump 65. In this state, the controller 5 drives the air pump 65 to generate a preset pressure Pks in the positive pressurization tanks 21 and generate a preset pressure Pfs in the negative pressurization tanks 24. After generating the preset pressures Pks, Pfs, the controller 5 closes the air flow path changeover valve 68 and sets the adjustment path (path formed of the flow volume regulation pipe 67 and the downstream portion 66*b* of the air pump pipe 66) as the usage path. In this state, the controller 5 controls the drive of the air pump 65 to maintain the pressures in the positive pressurization tanks 21 and the negative pressurization tanks 24.

The preset pressures Pks, Pfs are pressures for appropriately setting the nozzle pressure of the inkjet heads 11 while circulating the ink at a predetermined flow volume, and are preset. In the embodiment, the preset pressure Pks in the positive pressurization tanks 21 is a positive pressure (increased above an atmospheric pressure/higher than the preset pressure Pfs) and the preset pressure Pfs in the negative pressurization tanks 24 are a negative pressure (decreased below the atmospheric pressure/lower than the preset pressure Pks).

Next, operations of the inkjet printer 1 are described with reference to FIG. 3.

Figure 3:
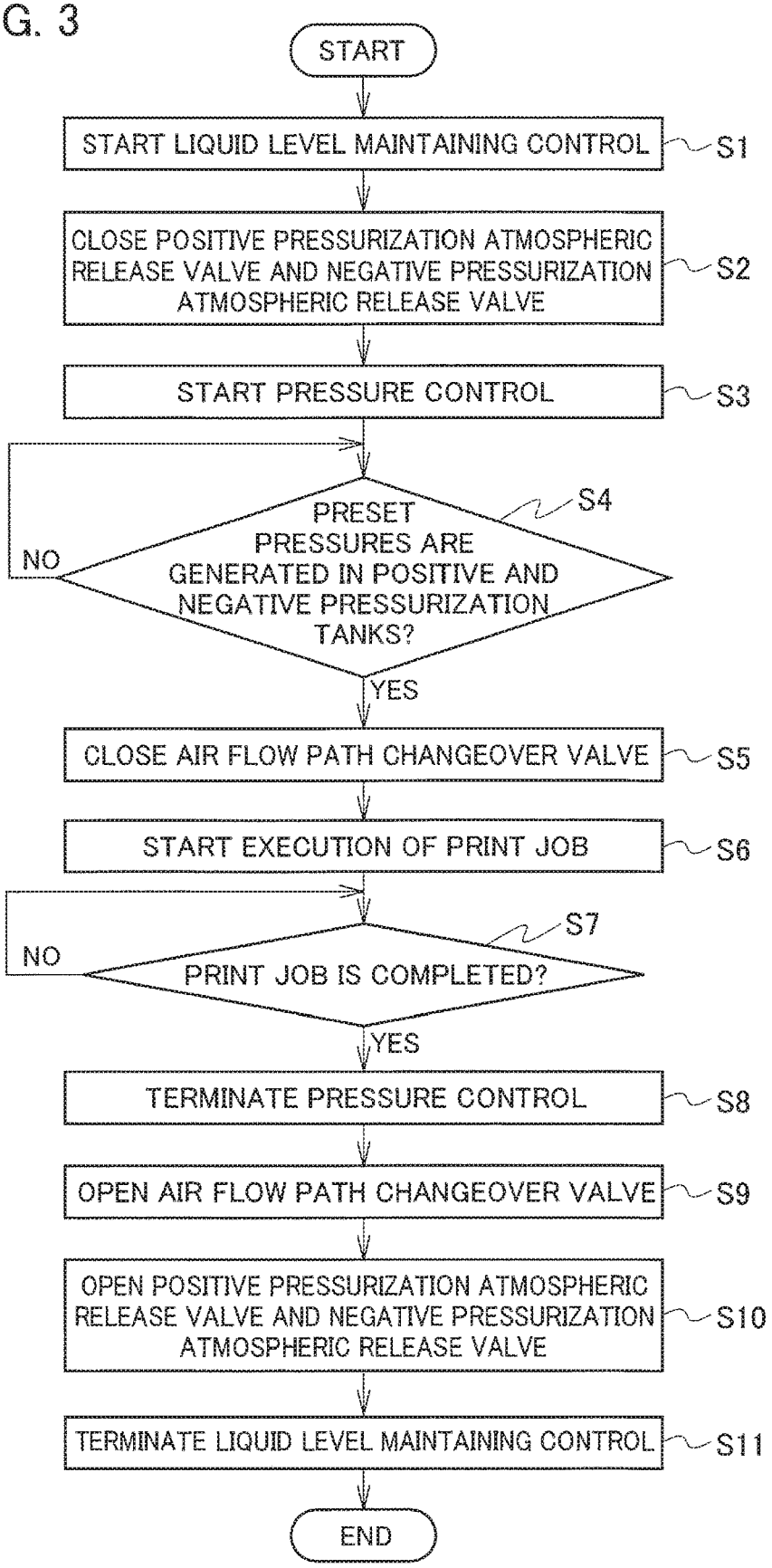
FIG. 3 is a flowchart illustrating operations of the inkjet printer.

The processing of the flowchart in FIG. 3 starts when the inkjet printer 1 receives a print job.

The controller 5 starts liquid level maintaining control (step S1). The liquid level maintaining control is control of maintaining the liquid levels in the positive pressurization tank 21 and the negative pressurization tank 24 in each print unit 2 at the reference height. The controller 5 controls the ink pump 25 and the ink reservoir valve 47 depending on the liquid level heights in the positive pressurization tank 21 and the negative pressurization tank 24.

Specifically, as illustrated in the following [Table 1], the controller 5 turns off the ink pump 25 and closes the ink reservoir valve 47 in the state where the positive pressurization tank liquid level sensor 33 and the negative pressurization tank liquid level sensor 38 are both on. The controller 5 turns off the ink pump 25 and closes the ink reservoir valve 47 also in the state where the positive pressurization tank liquid level sensor 33 is on and the negative pressurization tank liquid level sensor 38 is off.

TABLE 1

| | | Negative pressurization tank liquid level sensor | |
|---|---|---|---|
| | | On | Off |
| Positive pressurization tank liquid level sensor | On | Ink pump: off<br>Ink reservoir valve: closed | Ink pump: off<br>Ink reservoir valve: closed |
| | Off | Ink pump: on<br>Ink reservoir valve: closed | Ink pump: off<br>Ink reservoir valve: opened |

The controller 5 turns on the ink pump 25 and closes the ink reservoir valve 47 in the state where the positive pressurization tank liquid level sensor 33 is off and the negative pressurization tank liquid level sensor 38 is on. The controller 5 turns off the ink pump 25 and opens the ink reservoir valve 47 in the state where the positive pressurization tank liquid level sensor 33 and the negative pressurization tank liquid level sensor 38 are both off.

Subsequent to step S1, the controller 5 closes the positive pressurization atmospheric release valve 53 and the negative pressurization atmospheric release valve 60 (step S2). The positive pressurization tanks 21 are thereby set to the closed state through the positive pressurization communal air chamber 51 and the negative pressurization tanks 24 are set to the closed state through the negative pressurization communal air chamber 58.

In this embodiment, when the inkjet printer 1 is in a standby state, the positive pressurization atmospheric release valve 53 and the negative pressurization atmospheric release valve 60 are open and the positive pressurization pressure regulation valve 55 and the negative pressurization pressure regulation valve 62 are closed. Note that, the liquid level maintaining control may be started after the positive pressurization atmospheric release valve 53 and the negative pressurization atmospheric release valve 60 are closed in step S2.

Next, the controller 5 starts pressure control (step S3). The pressure control is control of generating and maintaining the aforementioned preset pressures Pks, Pfs for the ink circulation. The controller 5 controls the air pump 65, the positive pressurization pressure regulation valve 55, and the negative pressurization pressure regulation valve 62.

In the pressure control, the air pump 65, the positive pressurization pressure regulation valve 55, and the negative pressurization pressure regulation valve 62 are controlled depending on a detection value Pk of the positive pressurization pressure sensor 57 and a detection value Pf of the negative pressurization pressure sensor 64.

Specifically, as illustrated in the following [Table 2], when Pk<Pks and |Pf|<|Pfs|, the positive pressurization pressure regulation valve 55 and the negative pressurization pressure regulation valve 62 are closed and the air pump 65 is driven (turned on). The air pump 65 thereby sends air from the negative pressurization tanks 24 in the closed state to the positive pressurization tanks 21 in the closed state. The pressure in the negative pressurization tanks 24 thus decreases and the pressure in the positive pressurization tanks 21 increases.

TABLE 2

| | Air pump | Positive pressurization pressure regulation valve | Negative pressurization pressure regulation valve |
|---|---|---|---|
| Pk < Pks and \|Pf\| < \|Pfs\| | On | Closed | Closed |
| Pk ≥ Pks and \|Pf\| < \|Pfs\| | On | Opened | Closed |
| Pk < Pks and \|Pf\| ≥ \|Pfs\| | On | Closed | Opened |
| Pk ≥ Pks and \|Pf\| ≥ \|Pfs\| | Off | Opened | Opened |

When Pk≥Pks and |Pf|<|Pfs|, the positive pressurization pressure regulation valve 55 is opened and the negative pressurization pressure regulation valve 62 is closed. Moreover, the air pump 65 is driven. Air thereby flows out from the positive pressurization tanks 21 through the positive pressurization pressure regulation pipe 56 and the pressure in the positive pressurization tanks 21 decreases. Moreover, the air pump 65 sucks air from the negative pressurization tanks 24 in the closed state and the pressure in the negative pressurization tanks 24 decreases.

When Pk<Pks and |Pf|≥|Pfs|, the positive pressurization pressure regulation valve 55 is closed and the negative pressurization pressure regulation valve 62 is opened. Moreover, the air pump 65 is driven. The air pump 65 thereby sends air into the positive pressurization tanks 21 in the closed state and the pressure in the positive pressurization tanks 21 increases. Moreover, air flows into the negative pressurization tanks 24 through the negative pressurization pressure regulation pipe 63 and the pressure in the negative pressurization tanks 24 increases.

When Pk≥Pks and |Pf|≥|Pfs|, the positive pressurization pressure regulation valve 55 and the negative pressurization pressure regulation valve 62 are opened, and the air pump 65 is stopped (turned off). Air thereby flows out from the positive pressurization tanks 21 through the positive pressurization pressure regulation pipe 56 and the pressure in the positive pressurization tanks 21 decreases. Moreover, the air flows into the negative pressurization tanks 24 through the negative pressurization pressure regulation pipe 63 and the pressure in the negative pressurization tanks 24 increases.

The drive of the air pump 65 in the pressure control is performed at a drive rate (drive duty ratio) of 100%.

The air flow path changeover valve 68 is open in the standby state of the inkjet printer 1. The controller 5 maintains the air flow path changeover valve 68 in the open state at the start of the pressure control. Specifically, the controller 5 sets the main connection path (path formed of the upstream portion 66*a* and the downstream portion 66*b* of the air pump pipe 66) as the usage path used during the drive of the air pump 65.

Moreover, at the start of the pressure control, the pressures in the positive pressurization tanks 21 and the negative pressurization tanks 24 are the atmospheric pressure. Accordingly, at the start of the pressure control, Pk<Pks and |Pf|<|Pfs|. Thus, the controller 5 starts the drive of the air pump 65 at the start of the pressure control. When the air pump 65 is driven, air is sent from the negative pressurization communal air chamber 58 to the positive pressurization communal air chamber 51 through the main connection path (the upstream portion 66*a* and the downstream portion 66*b* of the air pump pipe 66). The negative pressurization communal air chamber 58 and the negative pressurization tanks 24 are thereby depressurized and the positive pressurization communal air chamber 51 and the positive pressurization tanks 21 are pressurized. As a result, the ink starts to flow from the positive pressurization tanks 21 to the inkjet heads 11.

After the start of the pressure control, the controller 5 determines whether the preset pressures Pks, Pfs are generated in the positive pressurization tanks 21 and the negative pressurization tanks 24, based on the detection value Pk of the positive pressurization pressure sensor 57 and the detection value Pf of the negative pressurization pressure sensor 64 (step S4). When the controller 5 determines that no preset pressure Pks is generated in the positive pressurization tanks 21 and/or no preset pressure Pfs is generated in the negative pressurization tanks 24 (step S4: NO), the controller 5 repeats the processing of step S4 until the determination result in step S4 becomes YES.

Meanwhile, when the controller 5 determines that the preset pressure Pks is generated in the positive pressurization tanks 21 and the preset pressure Pfs is generated in the negative pressurization tanks 24 (step S4: YES), the controller 5 closes the air flow path changeover valve 68 (step S5). The usage path used during the drive of the air pump 65 is thereby changed over to the adjustment path (path formed of the flow volume regulation pipe 67 and the downstream portion 66*b* of the air pump pipe 66).

After the preset pressure Pks is generated in the positive pressurization tanks 21 and the preset pressure Pfs is generated in the negative pressurization tanks 24, the controller 5 maintains the pressure in the positive pressurization tanks 21 at the preset pressure Pks and maintains the pressure in the negative pressurization tanks 24 at the preset pressure Pfs by performing the aforementioned pressure control. When the air pump 65 is driven to maintain the pressures, air is sent from the negative pressurization communal air chamber 58 to the positive pressurization communal air chamber 51 through the adjustment path (the flow volume regulation pipe 67 and the downstream portion 66*b* of the air pump pipe 66).

Subsequent to step S5, the controller 5 starts execution of the print job (step S6). Specifically, the controller 5 causes the inkjet heads 11 to eject the inks based on the print job and print an image on the sheet transferred by the transfer unit 4.

During the execution of the print job, in each print unit 2, the ink is supplied from the positive pressurization tank 21 to the inkjet head 11 and the ink not consumed in the inkjet head 11 is collected in the negative pressurization tank 24. When the positive pressurization tank liquid level sensor 33 is off and the negative pressurization tank liquid level sensor 38 is on, the ink pump 25 is driven by the liquid level maintaining control and the ink is sent from the negative pressurization tank 24 to the positive pressurization tank 21. The printing is performed with the ink being circulated as described above.

Moreover, in the ink circulation, the controller 5 adjusts the ink temperature by controlling the ink temperature adjuster 26 such that the detection temperature of the ink temperature sensor 27 is maintained within an appropriate temperature range.

After the start of the execution of the print job, the controller 5 determines whether the print job is completed (step S7). When the controller 5 determines that the print job is not completed (step S7: NO), the controller 5 repeats the processing of step S7 until the determination result in step S7 becomes YES (that is, until the print job is completed).

Meanwhile, when the controller 5 determines that the print job is completed (step S7: YES), the controller 5 terminates the pressure control (step S8). When the air pump 65 is being driven at this time, the controller 5 stops the air pump 65. Moreover, when at least one of the positive pressurization pressure regulation valve 55 and the negative pressurization pressure regulation valve 62 is open, the controller 5 closes the open regulation valve.

Next, the controller 5 opens the air flow path changeover valve 68 (step S9). The main connection path (path formed of the upstream portion 66*a* and the downstream portion 66*b* of the air pump pipe 66) is thereby set as the usage path used during the drive of the air pump 65 (the usage path is reset to the main connection path).

Next, the controller 5 opens the positive pressurization atmospheric release valve 53 and the negative pressurization atmospheric release valve 60 (step S10). The positive pressurization tanks 21 are thereby opened to the atmosphere through the positive pressurization communal air chamber 51 and the negative pressurization tanks 24 are opened to the atmosphere through the negative pressurization communal air chamber 58.

Then, the controller 5 terminates the liquid level maintaining control (step S11). A series of operations is thereby completed and the inkjet printer 1 is set to the standby state.

As described above, in the inkjet printer 1, the controller 5 generates the preset pressures Pks, Pfs and then closes the air flow path changeover valve 68 to set the adjustment path (path formed of the flow volume regulation pipe 67 and the downstream portion 66 b of the air pump pipe 66) as the usage path used during the drive of the air pump 65. In this state, the controller 5 controls the drive of the air pump 65 to maintain the pressures in the positive pressurization tanks 21 and the negative pressurization tanks 24.

This air passage configuration enables adjustment of the volume of air flowing from the negative pressurization communal air chamber 58 to the positive pressurization communal air chamber 51 when the air pump 65 is driven to maintain the pressures in the positive pressurization tanks 21 and the negative pressurization tanks 24. Specifically, the volume of air flowing from the negative pressurization communal air chamber 58 to the positive pressurization communal air chamber 51 can be adjusted without controlling the drive rate of the air pump 65. Accordingly, it is possible to avoid pressure fluctuation in the positive pressurization tanks 21 and the negative pressurization tanks 24 which is caused by unstable air flow volume in the case where the air pump 65 is driven at a low drive rate. As a result, it is possible to reduce fluctuation of the nozzle pressure of the inkjet heads 11 and suppress the decrease in print quality.

Note that, in the embodiment described above, the flow volume regulation pipe 67 and the air flow path changeover valve 68 are provided on the negative pressurization communal air chamber 58 side of the air pump 65. However, the flow volume regulation pipe 67 and the air flow path changeover valve 68 may be provided on the positive pressurization communal air chamber 51 side of the air pump 65.

The present invention is not limited to the embodiment described above. The present invention can be achieved with the constitutional elements thereof being modified within a scope not departing from the subject of the invention. Moreover, various embodiments can be achieved by combining the constitutional elements disclosed in the aforementioned embodiment. For example, some of the constitutional elements in the aforementioned embodiment can be omitted.

The entire contents of Japanese Patent Application No. 2015-186724 (filed on Sep. 24, 2015) are incorporated herein by reference. Although the present invention has been described above by referring to the embodiment of the present invention, the present invention is not limited to the aforementioned embodiment. The scope of the present invention is determined according to the scope of claim.

The invention claimed is:

1. An inkjet printer comprising:
- a print unit configured to eject ink from a nozzle of an inkjet head while circulating the ink along a circulation path;
- a pressurized space configured to be pressurized for circulation of the ink along the circulation path;
- a depressurized space configured to be depressurized for the circulation of the ink along the circulation path;
- a main connection path connecting the pressurized space and the depressurized space to each other;
- an adjustment path connecting the pressurized space and the depressurized space to each other, the adjustment path formed by a portion of the main connection path and a path having an air passage narrower than an air passage of the main connection path; and
- an air pump arranged in the portion of the main connection path and configured to send air from the depressurized space to the pressurized space.

2. The inkjet printer according to claim 1, further comprising a changeover device configured to change over a usage path from the main connection path to the adjustment path and from the adjustment path to main connection path, the usage path being a path used as an air passage between the pressurized space and the depressurized space in drive of the air pump.

3. The inkjet printer according to claim 2, further comprising a controller configured to drive the air pump with the main connection path set as the usage path by the changeover device to generate preset pressures respectively in the pressurized space and the depressurized space.

4. The inkjet printer according to claim 2, wherein the adjustment path is directly connected to the main connection path above the air pump, and extends from the depressurized space to the main connection path above the air pump.

5. The inkjet printer according to claim 2, further comprising a combined pipe separate from the adjustment path, the combined pipe configured to selectively connect a positive pressurization communal air chamber of the pressurized space and a negative pressurization communal air chamber of the depressurized space to the atmosphere.

6. The inkjet printer according to claim 3, wherein, after generation of the preset pressures, the controller is configured to control the drive of the air pump with the usage path changed over to the adjustment path by the changeover device to maintain pressures in the pressurized space and the depressurized space respectively at the preset pressures.

7. The inkjet printer according to claim 3, wherein the adjustment path is directly connected to the main connection path above the air pump, and extends from the depressurized space to the main connection path above the air pump.

8. The inkjet printer according to claim 3, further comprising a combined pipe separate from the adjustment path, the combined pipe configured to selectively connect a positive pressurization communal air chamber of the pressurized space and a negative pressurization communal air chamber of the depressurized space to the atmosphere.

9. The inkjet printer according to claim 6, wherein the adjustment path is directly connected to the main connection path above the air pump, and extends from the depressurized space to the main connection path above the air pump.

10. The inkjet printer according to claim 6, further comprising a combined pipe separate from the adjustment path, the combined pipe configured to selectively connect a positive pressurization communal air chamber of the pressurized space and a negative pressurization communal air chamber of the depressurized space to the atmosphere.

11. The inkjet printer according to claim 1, wherein the adjustment path is directly connected to the main connection path above the air pump, and extends from the depressurized space to the main connection path above the air pump.

12. The inkjet printer according to claim 1, further comprising a combined pipe separate from the adjustment path, the combined pipe configured to selectively connect a positive pressurization communal air chamber of the pressurized space and a negative pressurization communal air chamber of the depressurized space to the atmosphere.

13. The inkjet printer according to claim 1, wherein the pressurized space has a fixed volume and the depressurized space has a fixed volume.

14. The inkjet printer according to claim 1, wherein only a portion of the main connection path comprises the adjustment path, one end of the adjustment path is directly connected to one of the pressurized space and the depressurized space, and the other end of the adjustment path formed by the portion of the main connection path is directly connected to the other one of the pressurized space and the depressurized space.

15. The inkjet printer according to claim 1, wherein the path of the adjustment path having the air passage that is narrower than the air passage of the main connection path comprises a pipe that is thinner than a pipe comprising the main connection path, or a pipe, part of which has a smaller cross-sectional area than a cross-sectional area of the pipe comprising the main connection path.

16. The inkjet printer according to claim 1, wherein i) only a portion of the main connection path forms part of the adjustment path, and ii) the adjustment path directly connects the pressurized space with the depressurized space without the interposition of any valves therein.

17. The inkjet printer according to claim 1, wherein the pressurized space and the depressurized space are passive positive and negative pressurization communal air chambers, respectively, that are pressurized and depressurized, respectively, only by:

i) the pump;

ii) positive and negative pressurization atmospheric release valves, respectively; and iii) positive and negative pressurization pressure regulation valves, respectively.

18. An inkjet printer comprising:

a print unit configured to eject ink from a nozzle of an inkjet head while circulating the ink along a circulation path;

a pressurized space configured to be pressurized for circulation of the ink along the circulation path;

a depressurized space configured to be depressurized for the circulation of the ink along the circulation path;

a main connection path connecting the pressurized space and the depressurized space to each other;

an adjuster configured to adjust an amount of air flowing through the main connection path; and an air pump arranged in a portion of the main connection path and configured to send air from the depressurized space to the pressurized space.

19. The inkjet printer according to claim 18, wherein wherein the pressurized space has a fixed volume and the depressurized space has a fixed volume.

20. The inkjet printer according to claim 18, wherein the pressurized space and the depressurized space are passive positive and negative pressurization communal air chambers, respectively, that are pressurized and depressurized, respectively, only by:

i) the pump;

ii) positive and negative pressurization atmospheric release valves, respectively; and iii) positive and negative pressurization pressure regulation valves, respectively.

* * * * *